US007151504B1

(12) United States Patent
Boatman et al.

(10) Patent No.: US 7,151,504 B1
(45) Date of Patent: Dec. 19, 2006

(54) MULTI-LAYER RADOME

(75) Inventors: Robert K. Boatman, Binghamton, NY (US); Stephen G. Gonya, Endicott, NY (US)

(73) Assignee: Lockheed Martin Corporation, Bethesda, MD (US)

( * ) Notice: Subject to any disclaimer, the term of this patent is extended or adjusted under 35 U.S.C. 154(b) by 35 days.

(21) Appl. No.: 11/099,846

(22) Filed: Apr. 6, 2005

Related U.S. Application Data

(60) Provisional application No. 60/560,502, filed on Apr. 8, 2004, provisional application No. 60/560,493, filed on Apr. 8, 2004.

(51) Int. Cl.
*H01Q 1/42* (2006.01)

(52) U.S. Cl. ..... 343/872; 343/897

(58) Field of Classification Search ..... 343/872, 343/897; 442/59
See application file for complete search history.

(56) References Cited

U.S. PATENT DOCUMENTS

| | | | | |
|---|---|---|---|---|
| 3,002,190 | A * | 9/1961 | Oleesky et al. | 343/907 |
| 4,180,605 | A | 12/1979 | Gilbert et al. | |
| 4,358,772 | A | 11/1982 | Leggett | |
| 4,364,884 | A | 12/1982 | Traut | |
| 4,380,012 | A | 4/1983 | Bevan et al. | |
| 4,460,901 | A | 7/1984 | Tricoles et al. | |
| 4,506,269 | A | 3/1985 | Greene | |
| 4,620,890 | A | 11/1986 | Myers et al. | |
| 4,668,317 | A * | 5/1987 | Snyder | 156/98 |
| 4,780,262 | A * | 10/1988 | VonVolkli | 264/512 |
| 4,949,095 | A | 8/1990 | Neil et al. | |
| 4,980,696 | A | 12/1990 | Stone et al. | |
| 5,182,155 | A | 1/1993 | Roe | |
| 5,323,170 | A | 6/1994 | Lang | |
| 5,344,685 | A | 9/1994 | Cassell | |
| 5,408,244 | A | 4/1995 | Mackenzie | |
| 5,650,249 | A | 7/1997 | Dull et al. | |
| 5,652,631 | A | 7/1997 | Bullen et al. | |
| 5,662,293 | A | 9/1997 | Hower et al. | |
| 5,683,646 | A | 11/1997 | Reiling, Jr. | |
| 5,707,723 | A | 1/1998 | Harrison et al. | |
| 5,820,077 | A | 10/1998 | Sutliff et al. | |
| 5,849,234 | A | 12/1998 | Harrison et al. | |
| 5,958,557 | A | 9/1999 | Naor | |
| 5,969,686 | A | 10/1999 | Mackenzie | |
| 6,091,375 | A | 7/2000 | Goto et al. | |
| 6,107,976 | A | 8/2000 | Purinton | |
| 6,184,842 | B1 | 2/2001 | Leinweber et al. | |

(Continued)

FOREIGN PATENT DOCUMENTS

| | | |
|---|---|---|
| JP | 2001007625 | 1/2001 |

(Continued)

OTHER PUBLICATIONS

Royal Plastic Manufacturing, Inc.'s website, http://www.rpm-composites.com/featured_product.htm, visited on May 7, 2004.

(Continued)

*Primary Examiner*—Tan Ho
(74) *Attorney, Agent, or Firm*—Michael Best & Friedrich LLP

(57) ABSTRACT

A radome that includes a first plurality of plies arranged to define a window portion and a second plurality of plies arranged to define an attachment portion. A first portion of the first plurality of plies is also included within the second plurality of plies and a second portion of the first plurality of plies is not included in the second plurality of plies.

22 Claims, 7 Drawing Sheets

U.S. PATENT DOCUMENTS

| | | | | |
|---|---|---|---|---|
| 6,323,825 | B1 | 11/2001 | Zidek et al. | |
| 6,335,699 | B1 | 1/2002 | Honma | |
| 6,380,904 | B1 | 4/2002 | Ogawa | |
| 6,433,753 | B1 | 8/2002 | Zimmermann | |
| 6,437,757 | B1 | 8/2002 | Butler | |
| 6,476,771 | B1 | 11/2002 | McKinzie, III | |
| 6,518,936 | B1 | 2/2003 | Dull | |
| 6,529,090 | B1 | 3/2003 | Lam | |
| 6,639,567 | B1 | 10/2003 | Chang et al. | |
| 6,918,985 | B1 * | 7/2005 | Geyer | 156/285 |
| 2003/0052810 | A1 | 3/2003 | Artis et al. | |
| 2005/0014430 | A1 * | 1/2005 | Fredberg et al. | 442/59 |

FOREIGN PATENT DOCUMENTS

| | | |
|---|---|---|
| JP | 2002299938 | 10/2002 |
| JP | 2003238929 | 8/2003 |
| WO | WO 96/35567 | 11/1996 |

OTHER PUBLICATIONS

Chelton Radomes' website, http://www.radomes.co.uk/design.htm, visited on May 7, 2004.

SPG Media PLC, Air Force Technology website, http://www.airforce-technology.com/projects/f2, visited on May 7, 2004.

E.I. du Pont de Nemours and Company, "What is Nomex® ?", http://www.dupont.com/nomex/whatisnomex_main.html, visited on Nov. 15, 2004.

Argentini, et al., "Project Galileo IV: A New Approach to Small UAV Integrated Design," American Institute of Aeronautics and Astronautics, pp. 1-12; date is not available.

Howell Laboratories, Inc., Shively Labs "Radomes."; date is not available.

* cited by examiner

MULTI-LAYER RADOME

RELATED APPLICATION DATA

This application claims benefit under 35 U.S.C. Section 119(e) of co-pending U.S. Provisional Application No. 60/560,502 filed Apr. 8, 2004, and U.S. Provisional Application No. 60/560,493 filed Apr. 8, 2004, both of which are fully incorporated herein by reference.

BACKGROUND

The present invention relates generally to a cover for a radar antenna (radome). More particularly, the present invention relates to a composite radome.

Radomes are used to cover a radar antenna to protect the antenna from wind or foreign objects. In aircraft applications, the radome also provides aerodynamic improvements that allow the aircraft to fly with the radar antenna.

Radomes are often manufactured as composites. However, the materials used are not completely transparent to the electromagnetic energy emitted or received by the radar antenna. As such, the radome may reduce the overall performance of the radar system. In addition, the formation of the radome can affect the performance of the radome. Thus, the use of some radomes may result in operational limitations of the radar system due to the manufacturing techniques, materials, or processes used to build the radome. For example, it is often necessary to assembly multiple sheets of material to define a ply or layer of the radome. Adjacent sheets meet and define a seam that can interfere with or attenuate a radar signal, thereby degrading the performance of the radar system. Furthermore, excess thickness may be used to provide strength for the radome but may unnecessarily degrade the performance of the radar system.

SUMMARY

The present invention provides a radome adapted to cover a radar antenna for an aircraft, ship, or other radar installation. In one construction, the invention provides a radome that includes a first plurality of plies arranged to define a window portion and a second plurality of plies arranged to define an attachment portion. A first portion of the first plurality of plies is also included within the second plurality of plies and a second portion of the first plurality of plies is not included in the second plurality of plies.

In another construction, the invention provides a radome adapted to cover a radar antenna. The radome includes an outer skin that defines a first interior space having a first contour. The outer skin also defines an exterior surface of a window portion and of an attachment portion. A first core portion is formed to substantially correspond to the first contour and is disposed within the first interior space adjacent the outer skin. The first core portion defines a second interior space. A middle skin is disposed at least partially within the second interior space adjacent the first core and defines a third interior space having a second contour. The middle skin extends into the window portion and the attachment portion. A second core portion is formed to substantially correspond to the second contour and is disposed within the third interior space adjacent the middle skin. The second core portion defines a fourth interior space. An inner skin is disposed at least partially within the fourth interior space adjacent the second core. The inner skin extends into the window portion and the attachment portion and defines an interior surface of the window portion and the attachment portion.

Additional features and advantages will become apparent to those skilled in the art upon consideration of the following detailed description.

BRIEF DESCRIPTION OF THE DRAWINGS

The detailed description particularly refers to the accompanying figures in which.

Before any embodiments of the invention are explained, it is to be understood that the invention is not limited in its application to the details of construction and the arrangements of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof is meant to encompass the items listed thereafter and equivalence thereof as well as additional items. The terms "connected," "coupled," and "mounted" and variations thereof are used broadly and encompass direct and indirect connections, couplings, and mountings.

DETAILED DESCRIPTION

Figure 1:
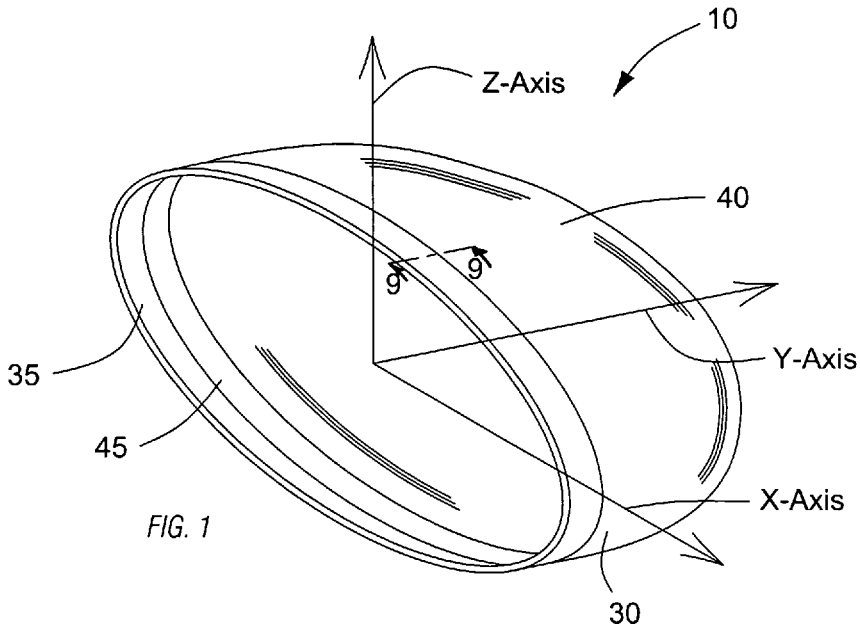
FIG. 1 is a perspective view of a radome.
Figure 2:
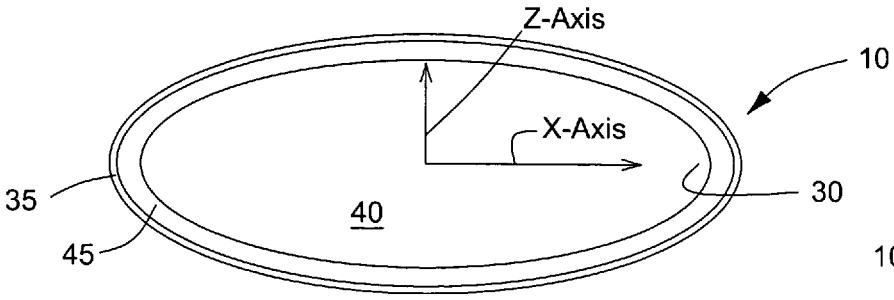
FIG. 2 is a rear view of the radome of FIG. 1.
Figure 2A:
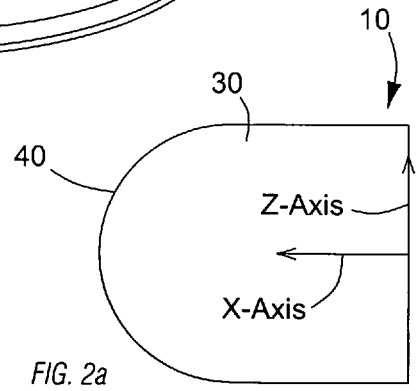
FIG. 2*a* is a schematic side view of the radome of FIG. 1.

FIG. 1 illustrates a radar dome (radome) 10 commonly used to cover a radar antenna in an aircraft, ship, or other radar installation. Typically, aircraft radar antennas are placed at the nose or wingtip of the aircraft. However, some aircraft include radar antennas that extend from another surface of the aircraft (e.g., the belly of the aircraft). As such the radome 10 not only needs to allow the transmission of electromagnetic energy in the wavelengths commonly used in radar systems, but should also be aerodynamic. As shown in FIGS. 2 and 2*a*, the radome 10 is substantially ellipsoid in shape, and defines three axes. More specifically, the radome 10 can be defined as a semi-ellipsoid, or truncated ellipsoid with an extended attachment portion. An X-axis extends along the long axis of the elliptical outline of the radome 10 as illustrated in FIG. 2, while a Z-axis extends along the short axis of the ellipse. A Y-axis extends from the center of the ellipse of FIG. 2 through the leftmost portion of the radome 10, as illustrated in FIG. 2*a*. Generally, a radar antenna is positioned within the radome 10, at or near the intersection of the X-axis, the Y-axis, and the Z-axis.

The radome 10 includes a C-sandwich portion 30 and a solid flange portion 35 as shown in FIG. 1. The C-sandwich portion 30 defines a window portion 40 through which electromagnetic radiation is transmitted and received. As such, it is desirable that the window portion 40 be as transparent as possible to electromagnetic radiation in the wavelengths typically used for radar applications. A densified-core region 45 is disposed between the C-sandwich portion 30 and the solid flange portion 35 and provides for a smooth transition between the two portions 30, 35.

The radome 10 is formed from a composite of plies. Not all of the plies extend throughout the entire radome. For example, some plies may extend throughout the radome 10, while other plies are positioned in only one or two of the radome regions (the solid flange portion 35, the C-sandwich portion 40, or the densified-core portion 45). In addition, not all of the plies are formed from the same material. Some plies may be formed using cloth, filler, or cores as will be described with regard to FIGS. 4 and 9.

Figure 4:
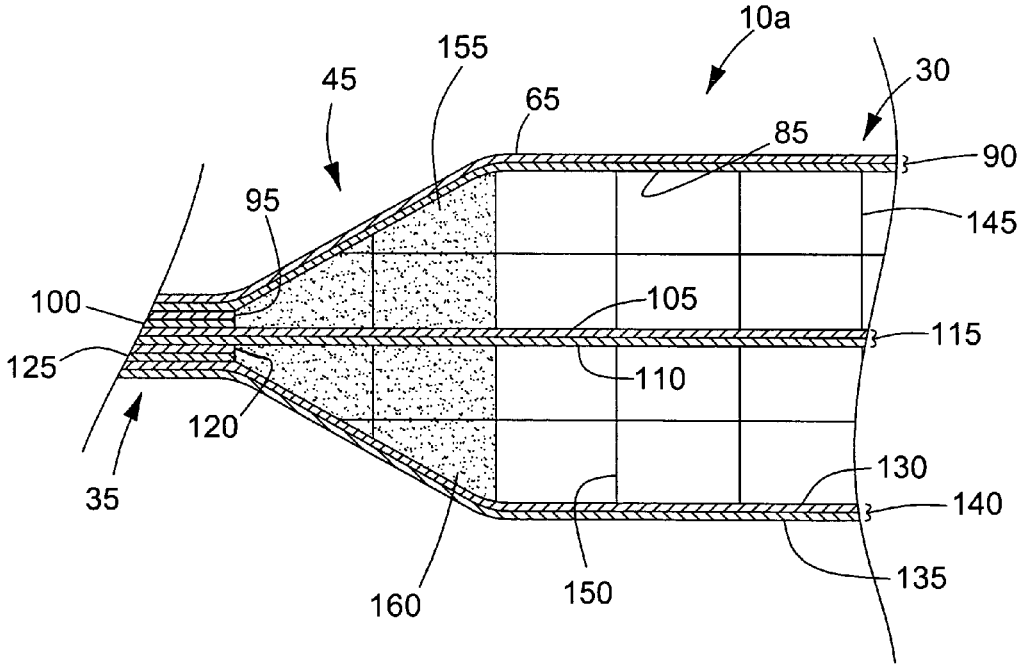
FIG. 4 is a schematic illustration of a portion of the radome of FIG. 1 including the attachment portion and the densified-core portion.
Figure 9:
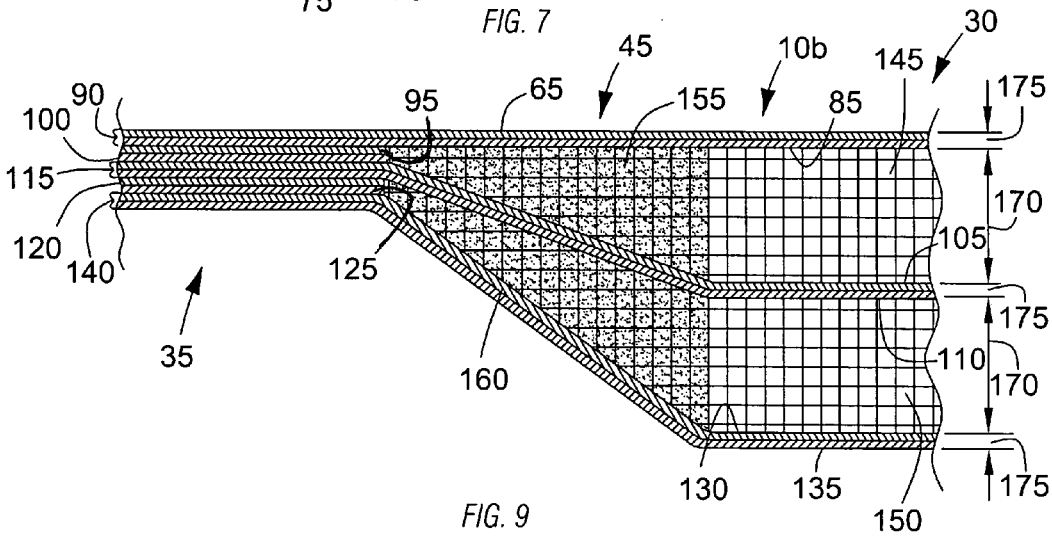
FIG. 9 is a section view of a portion of the radome of FIG. 1 taken along line 9—9 of FIG. 1.

FIGS. 4 and 9 illustrate two constructions of a radome 10*a*, 10*b* in which the solid flange portion 35 is comprised of 10 plies of a polyethylene material that define a substantially solid section. The solid flange portion 35 provides an attachment surface that mates with the aircraft, or other component to fix the position of the radome 10*a*, 10*b*.

Figure 11:
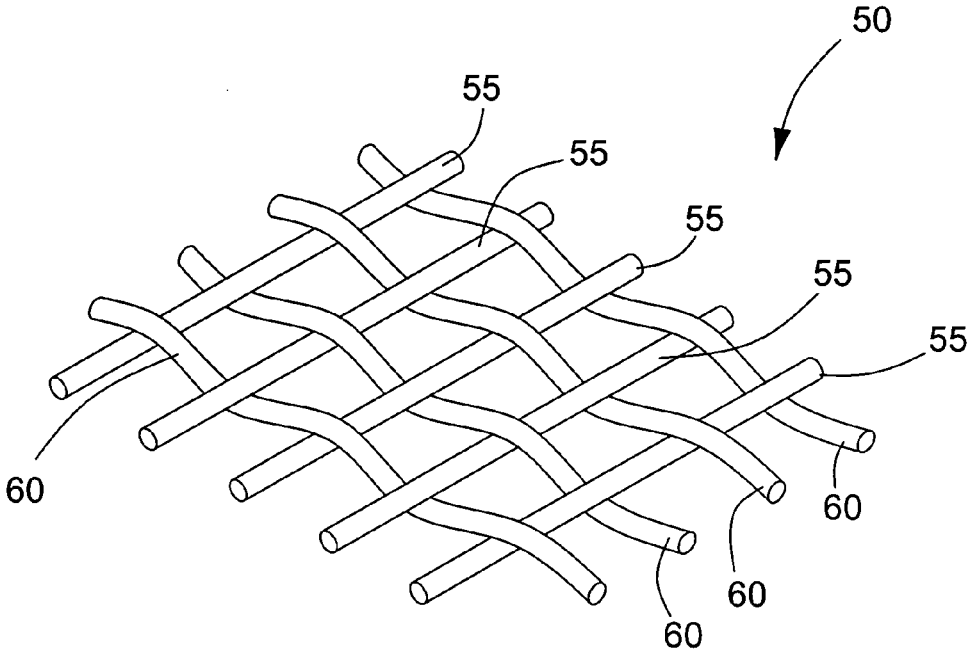
FIG. 11 is an enlarged perspective view of a portion of cloth woven in a square-wave pattern.

An extended chain polyethylene fiber material can be used to form the individual plies of the radome 10. One suitable material is sold by Honeywell International, Inc. as SPECTRA Fiber 955. The fibers are woven into a cloth 50 following a particular pattern to achieve the desired properties. In one construction, illustrated in FIG. 11, a square weave pattern is used to form the cloth 50 with other patterns being possible. In a square weave pattern, a plurality of fibers is arranged along substantially straight parallel lines. The remaining fibers are weaved between the straight fibers at about a right angle. The straight fibers are referred to herein as warp fibers 55 and the weaved fibers are referred to as fill fibers 60.

The weaved cloth 50 is impregnated with an adhesive, generally an epoxy resin that sets when cured to allow the cloth 50 to become substantially rigid. One suitable epoxy resin is sold by FiberCote Industries, Inc., 172 East Aurora Street, Waterbury, Conn. as FIBERCOTE E761. A certain quantity of epoxy is applied to the cloth 50 to achieve the desired results. The cloth 50 is able to hold a maximum capacity of epoxy, designated as 100 percent. Generally, it is desirable to apply between about 30 percent and 80 percent of the maximum epoxy capacity to the cloth 50. In one construction, a quantity of epoxy of approximately 55 percent is applied to the cloth 50. This percentage provides sufficient bonding and strength without significant adverse affects to the radar system.

Before proceeding with the description of the solid flange portion 35 it should be noted that each cloth layer 50 is a ply. However, each ply does not necessarily include a cloth layer 50. In addition, some plies do not extend into the solid flange portion 35. As such, the layer number within the solid flange portion 35 may not correspond with the ply number listed in Table 1, which is assigned based on the construction order employed. For example, the fifth layer in the solid flange portion 35 may correspond with the seventh ply of the radome 10, as listed in table 1.

Figure 5:
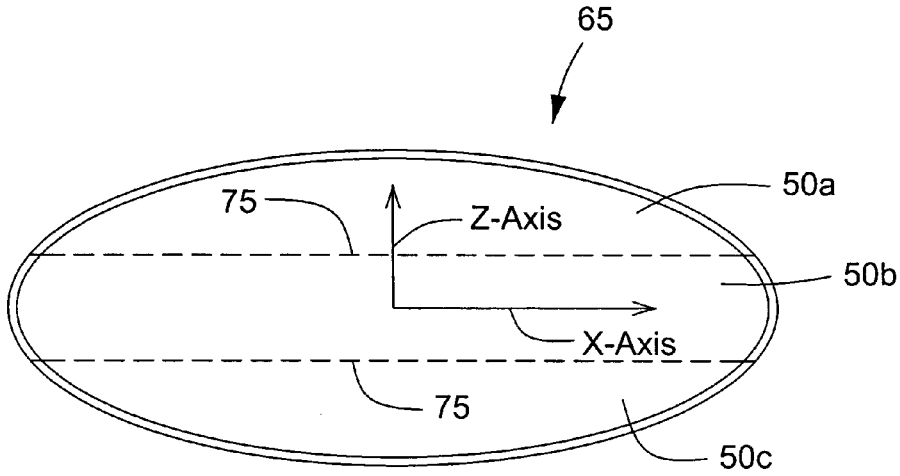
FIG. 5 is a rear view of a ply of the radome of FIG. 1 illustrating the location and orientation of the seams.
Figure 6:
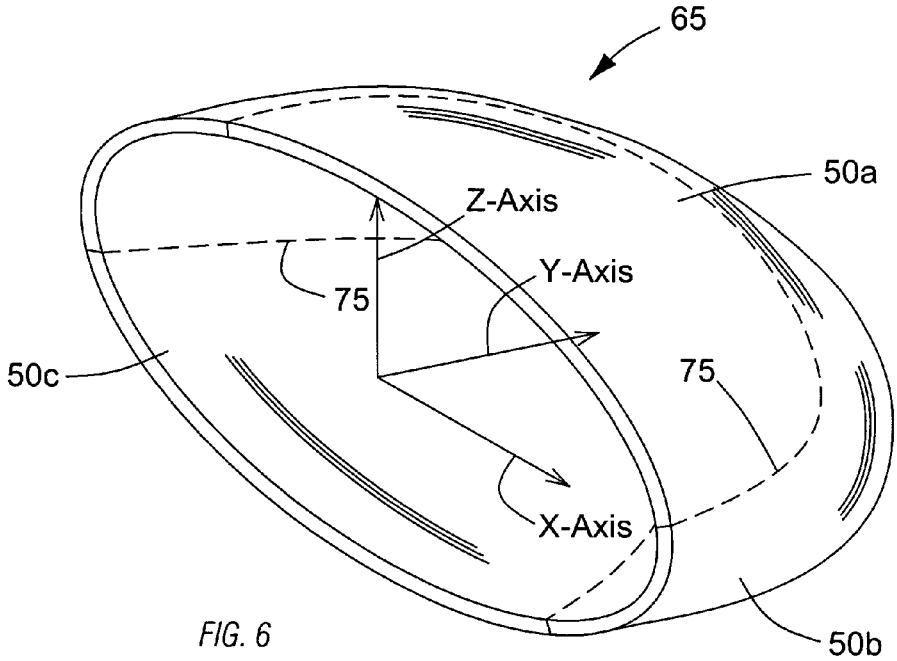
FIG. 6 is a perspective view of the ply of FIG. 5.
Figure 10:
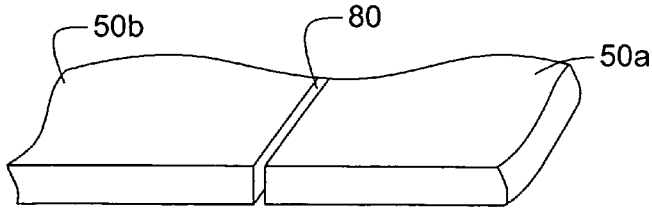
FIG. 10 is a perspective view of a butt joint between adjacent sheets of a ply.
Figure 12:
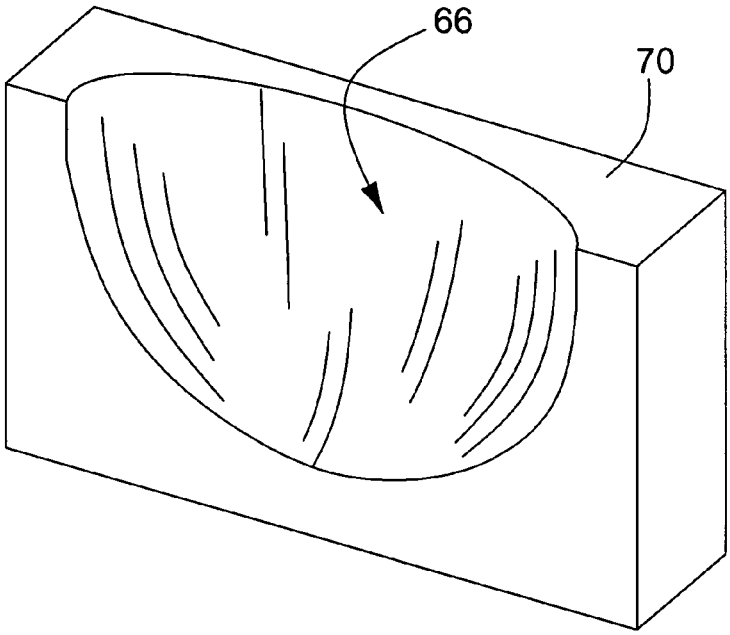
FIG. 12 is a perspective view of one half of a mold.

A first layer 65, corresponding to the first ply, of epoxy impregnated cloth 50 (prepreg cloth) is positioned within a cavity 66 defined by two mold halves 70 (FIG. 12) of a female outside mold (OML) to define an inner surface. The cloth 50 is arranged such that the fibers 55, 60 are oriented at a desired angle. Once positioned, the first layer 65 also defines an outer most surface of the radome 10. As such, it is desirable that it define a smooth outer surface. The shape of the radome 10 makes it necessary to use multiple sheets of cloth 50 to achieve the desired smooth placement of the ply 65. With reference to FIGS. 5 and 6, one arrangement of the sheets 50 defining a ply is illustrated. In this arrangement, three pieces of cloth 50*a*, 50*b*, 50*c* are employed to completely define the ply. The three sheets 50*a*, 50*b*, 50*c* cooperate to define two seams 75 that lie in distinct planes which are substantially parallel to the X-axis. It has been found that seams 75 arranged in distinct planes that are parallel to the X-axis have a smaller adverse affect on radar system performance than do seams 75 arranged in other configurations. Butt joints 80, illustrated in FIG. 10, are employed at the seams 75 between the sheets 50*a*, 50*b*, 50*c*. The use of butt joints 80, rather than more common overlapping joints, reduces the adverse impact of the seams 75 on the radar system. As such, butt joints 80 are preferred. Other arrangements may employ other types of joints or other seam arrangements. However, these arrangements may result in a reduction in the performance of the radar system.

Figure 8:
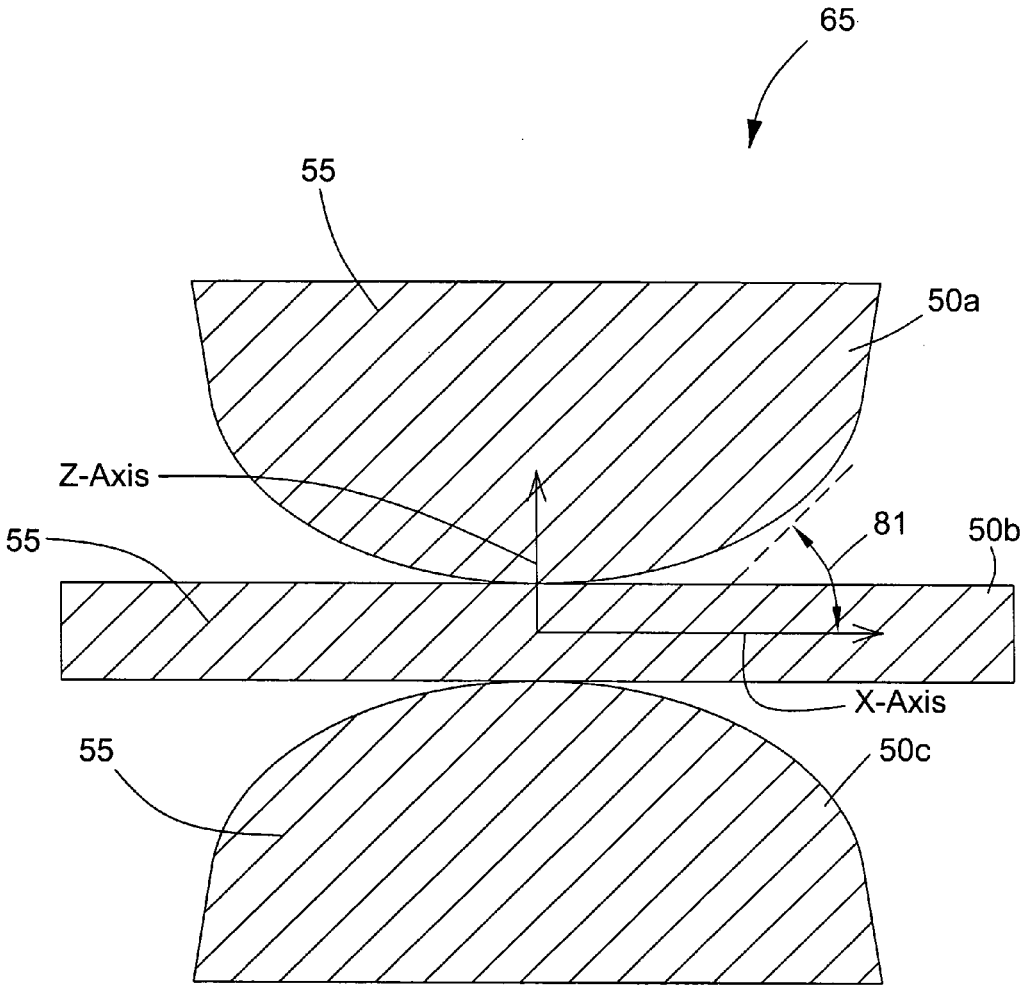
FIG. 8 is a schematic layout view of the ply of FIG. 5 illustrating the warp angle.

In addition to the arrangement of the particular sheets 50*a*, 50*b*, 50*c* and seams 75 that make up the ply 65, the orientation of the warp and fill fibers 55, 60 of the sheets 50*a*, 50*b*, 50*c* is also important. As shown in FIG. 8, the warp fibers 55 are arranged at an angle 81 relative to the X-axis (e.g., plus 45 degrees). Because a square weave is employed, the angle of the fill fibers 60 will be rotated about 90 degrees relative to the angle 81 of the warp fibers 55 (e.g., minus 45 degrees). The angle of the warp and fill fibers 55, 60 of all of the plies for one possible construction are outlined in Table 1. Of course, other constructions may employ other angles or other weave patterns as desired.

TABLE 1

| Ply No. | Material | Angle | Portion |
|---|---|---|---|
| 1 | Cloth | Warp +45/Fill −45 | All |
| 2 | Cloth | Fill −45/Warp +45 | All |
| 3 | Core | L-Dir 0° | C-sandwich |
| 4 | Filler | N/A | Densified Core |
| 5 | Cloth | Warp 0/Fill +90 | Solid Flange |
| 6 | Cloth | Fill +90/Warp 0 | Solid Flange |
| 7 | Cloth | Warp +45/Fill −45 | All |
| 8 | Cloth | Fill −45/Warp +45 | All |
| 9 | Core | L-Dir 0° | C-sandwich |
| 10 | Filler | N/A | Densified Core |
| 11 | Cloth | Warp 0/Fill +90 | Solid Flange |
| 12 | Cloth | Fill +90/Warp 0 | Solid Flange |
| 13 | Cloth | Warp +45/Fill −45 | All |
| 14 | Cloth | Fill −45/Warp +45 | All |

A second layer 85 of prepreg cloth 50 is positioned adjacent the inner surface of the first layer 65. Again, the orientation is as described below and shown in Table 1. Due to the shape of the radome 10, multiple pieces of cloth 50 are required to form many of the layers described herein. As discussed with regard to the first ply 65, adjacent pieces of cloth 50 are positioned to define seams 75 made up of butt joints 80 (FIG. 10) that extend substantially parallel to the X-axis to minimize the effect on radar system performance.

The first and second plies 65, 85 cooperate to define an outer skin 90 of the radome 10 having an inner surface. The outer skin 90 defines the outer surface of the C-sandwich portion 30, the densified-core portion 45, and the solid flange portion 35. A third cloth layer 95 (ply 5) having an inner surface is positioned adjacent the inner surface of the outer skin 90, but only within the solid flange portion 35. Because the third layer 95 does not extend into the window portion 40, the seam arrangement will not significantly affect radar system performance. As such, a single strip of cloth 50 with a butt joint or an overlap can be employed if desired. A fourth layer 100 (ply 6), similar to the third layer 95 and including an inner surface, is positioned adjacent the inner surface of the third layer 95. Again, the fourth layer 100 does not extend into the window portion 40 and can employ any joint arrangement desired. The angles of the warp and fill fibers 55, 60 of the third and fourth layers 95, 100 (ply 5 and ply 6) are listed in Table 1, with other angles also being suitable for use to manufacture radomes 10.

A fifth cloth layer 105 (ply 7) having an inner surface is positioned adjacent the inner surface of the fourth layer 100 and extends into the C-sandwich portion 30, the densified-core portion 45, and the solid flange portion 35. As such, multiple sheets 50*a*, 50*b*, 50*c* are employed to maintain the smooth wrinkle-free layout, while following the contour of the radome 10. As with the first ply 65 and the second ply 85, the seams 75 between adjacent sheets 50*a*, 50*b*, 50*c* are preferably arranged in distinct planes that are substantially parallel to the X-axis of the radome 10 as shown in FIGS. 5 and 6. In addition, butt joints 80 (FIG. 10) are employed to reduce the adverse affect the seams 75 may have on the operation of the radar system. The orientation of the warp and fill fibers 55, 60 for the fifth layer 105 (ply 7) is as described in Table 1, with other angles also being possible.

A sixth cloth layer 110 (ply 8) having an inner surface is positioned adjacent the inner surface of the fifth layer 105 and extends into the C-sandwich portion 30, the densified-core portion 45, and the solid flange portion 35. As such, multiple sheets 50*a*, 50*b*, 50*c* are employed to maintain the smooth wrinkle-free layout, while following the contour of the radome 10. As with the first layer 65, the second layer 85, and the fifth layer 105, the seams 75 between adjacent sheets 50*a*, 50*b*, 50*c* are arranged in distinct planes that are substantially parallel to the X-axis of the radome 10, as shown in FIGS. 5 and 6. In addition, butt joints 80 (FIG. 10) are employed to reduce the adverse effect the seams 75 may have on the operation of the radar system. The orientation of the warp and fill fibers 55, 60 for the sixth layer 110 (ply 8) are as described in Table 1, with other angles also being possible.

The fifth and sixth layers 105, 110 cooperate to define a middle skin 115 of the radome 10. The middle skin 115 extends into the C-sandwich portion 30, the densified-core portion 45, and the solid flange portion 35. A seventh cloth layer 120 (ply 11) is positioned within the sixth ply 110, but only within the solid flange portion 35. Because the seventh layer 120 does not extend into the window portion 40, the seam arrangement will not affect radar system performance. As such a single strip of material with a butt joint or an overlap can be employed if desired. An eighth layer 125 (ply 12), similar to the seventh layer 120, is positioned within the seventh layer 120. Again, the eighth layer 125 does not extend into the window portion 40 and can employ any joint arrangement desired. The angles of the warp and fill fibers 55, 60 of the seventh and eighth layers 120, 125 (ply 11 and ply 12) are listed in Table 1, with other angles also being suitable for use to manufacture radomes 10.

A ninth cloth layer 130 (ply 13) having an inner surface is positioned adjacent the inner surface of the eighth layer 125. The ninth layer 130 extends into the C-sandwich portion 30, the densified-core portion 45, and the solid flange portion 35. As such, multiple sheets 50*a*, 50*b*, 50*c* are employed to maintain the smooth wrinkle-free layout, while following the contour of the radome 10. As with the first layer 65, the second layer 85, the fifth layer 105, and the sixth layer 110, the seams 75 between adjacent sheets 50*a*, 50*b*, 50*c* are preferably arranged in distinct planes that are substantially parallel to the X-axis of the radome 10, as shown in FIGS. 5 and 6. In addition, butt joints 80 (FIG. 10) are employed to reduce any effect the seams 75 may have on the operation of the radar system. The orientation of the warp and fill fibers 55, 60 of the ninth layer 130 (ply 13) are as described in Table 1, with other angles also being possible.

A tenth cloth layer 135 (ply 14) is positioned adjacent the inner surface of the ninth layer 130. The tenth layer 135 extends into the C-sandwich portion 30, the densified-core portion 45, and the solid flange portion 35. Again, multiple sheets 50*a*, 50*b*, 50*c* are employed to maintain the smooth wrinkle-free layout, while following the contour of the radome 10. As with the first layer 65, the second layer 85, the fifth layer 105, the sixth layer 110, and the ninth layer 130, the seams 75 between adjacent sheets 50*a*, 50*b*, 50*c* are preferably arranged in distinct planes that are substantially parallel to the X-axis of the radome 10, as shown in FIGS. 5 and 6. In addition, butt joints 80 (FIG. 10) are employed to reduce the adverse effect the seams 75 may have on the operation of the radar system. The orientation of the warp and fill fibers 55, 60 of layer 10 (ply 14) is as described in Table 1, with other angles also being possible.

The ninth and tenth layers 130, 135 cooperate to define an inner skin 140 of the radome 10. The inner skin 140 extends into the C-sandwich portion 30, the densified-core portion 45, and the solid flange portion 35. As just described, the solid flange portion 35 includes ten layers of epoxy-impregnated cloth 50 that bond to one another during curing to define a rigid solid structure. Each of the layers illustrated in FIGS. 4 and 9 is generally between 0.007 and 0.010 inches thick (before curing) with other thicknesses being possible. Thus, the completed solid flange portion 35 is between about 0.07 and 0.10 inches thick.

Figure 7:
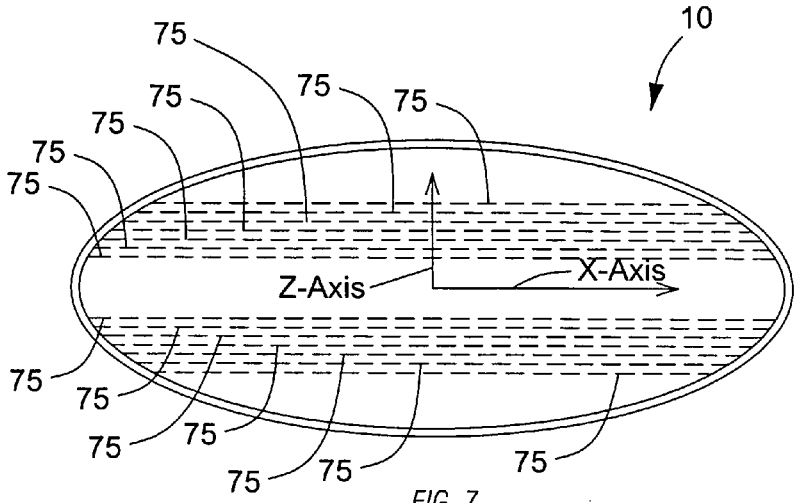
FIG. 7 is a schematic illustration of the radome of FIG. 1 illustrating the locations of the seams.

As discussed, the plies that make up the inner skin 140, the middle skin 115, and the outer skin 90 extend into the window portion 40 of the C-sandwich portion 30. Each of these is made up of multiple sheets 50*a*, 50*b*, 50*c* that cooperate to define the seams 75. The seams 75 are all preferably oriented such that they are substantially parallel to the X-axis and lie in distinct planes. In addition, as illustrated in FIG. 7, the seams 75 of each ply are arranged such that they do not overlap one another when viewed from the open end of the radome 10. More specifically, each seam 75 is disposed substantially within a distinct plane that is parallel to the X-Y plane (i.e., the plane defined by the X-axis and the Y-axis). Each of the planes that contains a seam 75 is substantially parallel to all of the other planes that include a seam 75 and is spaced a non-zero distance from each of the remaining planes. Thus, none of the seams are coplanar. For example, in one construction, there is at least 0.5 inches between any two seams 75 and at least one inch between two seams 75 defined by a single ply. With this arrangement, the seams 75 are distributed over the window portion 40 substantially uniformly. This arrangement assures that electromagnetic radiation transmitted or received by the radar antenna (positioned at or near the intersection of the X-axis, Y-axis, and Z-axis) passes through no more than one seam 75.

The C-sandwich portion 39 includes the window portion 40 and is at least partially defined by the outer skin 90 (ply 1 and ply 2), the middle skin 115 (ply 7 and ply 8), and the inner skin 140 (ply 13 and ply 14). To complete the C-sandwich portion 30, a first honeycomb core portion 145 is positioned between the outer skin 90 and the middle skin 115, and a second honeycomb core portion 150 is positioned between the middle skin 115 and the inner skin 140. The first core portion 145 defines the third ply and the second core portion 150 defines the ninth ply. Each of the core portions 145, 150 extends into the densified-core portion 45 as well as the C-sandwich portion 30.

The core portions 145, 150 are relatively rigid components that include a plurality of walls that intersect to define a plurality of cavities, or cells. Generally, the cores 145, 150 are manufactured in such a way as to produce different material properties depending on the orientation of the core 145, 150. As such, a ribbon direction is defined by each core 145, 150 and can be used to orient the core 145, 150 as desired. For cores 145, 150 that employ substantially orthogonal walls, the cavities have rectangular cross-sections in a plane orthogonal to the walls, as shown in FIG. 9. Other constructions may employ core portions 145, 150 that define round, pentagon, hexagon, octagon, or other polygonal-shaped cross-sections as desired. In preferred constructions, the core portions 145, 150 are manufactured from green (uncured or partially cured) nylon fiber material, such as Nomex, with other materials also being suitable for use.

Figure 3:
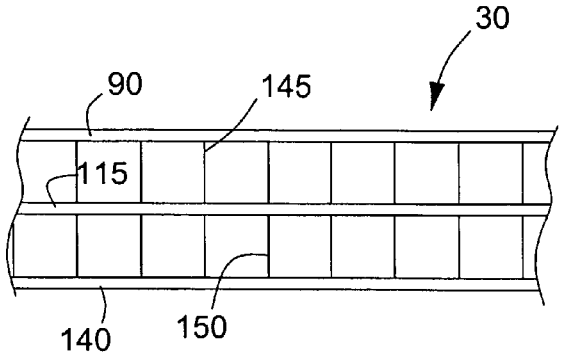
FIG. 3 is a cross-section of a C-sandwich window portion of the radome of FIG. 1.

In the construction illustrated in FIGS. 3, 4, and 9, the core portions 145, 150 are approximately 0.135 inches thick. Thus, the uncured C-sandwich portion 30 (including the inner skin 140, the middle skin 115, the outer skin 90, and two core portions 145, 150) is between about 0.315 and 0.330 inches with other thicknesses being possible. As will be discussed below, this thickness is reduced to between about 0.295 and 0.310 inches following curing. As one of ordinary skill in the art will realize, the actual thickness of the C-sandwich portion 30 could vary greatly. In addition, the thickness of the various plies before curing may be different from the thickness after curing. Thus, the thicknesses of the solid flange portion 35 and the C-sandwich portion 30 provided herein should not be interpreted as limiting, but rather should be used for relative comparison.

As described, the C-sandwich portion 30 is substantially thicker than the solid flange portion 35. Thus, the densified-core portion 45 provides for a smooth transition between these two portions 30, 35 of the radome 10. The densified-core portion 45, illustrated in FIGS. 4 and 9, includes the same plies as the C-sandwich portion 30. In addition, a fourth ply 155 is disposed within the cavities of the first core portion 145 that extend into the densified-core portion 45, and a tenth ply 160 is disposed within the cavities of the second core portion 150 that extend into the densified-core portion 45. The fourth and tenth plies 155, 160 are composed of a filler that preferably cures at room temperature and fills the cavities. These filled cavities, along with the core portions 145, 150 can be ground to a contour or at an angle (e.g., 45 degrees) to produce a smooth transition between the relatively thick C-sandwich portion 30 and the relatively thin solid flange portion 35. The construction of FIG. 4 includes a densified-core portion 35 shaped to transition both the outer skin 90 and the inner skin 140 toward the center of the wall. FIG. 9 illustrates a construction in which the densified-core portion 45*b* is shaped such that the inner skin 140 transitions outward to accommodate the thickness change. Thus, the construction of FIG. 9 produces a radome 10*b* with a smooth outer surface, while the construction of FIG. 4 produces a radome 10*a* with a contoured outer surface.

As illustrated in FIGS. 4 and 9, the completed radome 10*a*, 10*b* includes fourteen plies and is divided into three distinct portions; the solid flange portion 35, the densified-core portion 45, and the C-sandwich portion 30. The plies are employed and arranged as described in Table 1.

As one of ordinary skill will realize, there are many variations that could be employed in the manufacture of a composite structure such as a radome 10. As such, the following description should not be interpreted as limiting. Rather, the following is but one example of a process that is suited to manufacturing the described radome 10.

The first ply 65, which defines the outer surface of the radome 10, is positioned within the female mold 70 (e.g., epoxy-graphite female OML mold) that conforms to the desired finished shape of the radome 10. In most constructions, three sheets 50*a*, 50*b*, 50*c* are employed to complete the plies that extend throughout the radome 10, including the first ply 65. One center strip 50*b* runs parallel to the X-axis and two side pieces 50*a*, 50*c* complete the ply 65. Generally, the center strip 50*b* is at least one inch wide, with wider strips being preferred.

Each sheet 50*a*, 50*b*, 50*c* of the first ply 65 is arranged such that the angles of the warp and fill fibers 55, 60 match those listed in Table 1. Once the first ply 65 is positioned as desired within the mold 70, the first ply 65 is vacuum bag de-bulked. The second ply 85 is then positioned within the first ply 65. As described, the second ply 85 also preferably includes three sheets 50*a*, 50*b*, 50*c*. The second ply 85 is arranged such that it is oriented substantially as listed in Table 1. Thus, the angle 81 of the warp fibers 55 of the second ply 85 are offset 90 degrees relative to those of the first ply. This arrangement produces a substantially stress neutral structure that is less likely to distort during curing when compared to a non-stress neutral structure. Once the second ply 85 is positioned as desired within the first 65, the assembly is vacuum bag de-bulked. While many vacuum bag de-bulking processes are available, one process that works well includes a 30-minute de-bulking step at room temperature. Generally, a vacuum pressure of 25 in-Hg absolute or less is sufficient, with other vacuum pressures also being suitable. The de-bulking steps assure that the desired surface texture will be achieved on the outer skin 90 of the radome 10.

Next, the first core portion 145 (ply 3) is positioned adjacent the inner surface of the second ply 85. Before the core 145 can be positioned, the core portion 145 must be shaped to match the desired contour. However, the core portions 145 do not easily form to the desired shape. As such, green (uncured or partially cured) Nomex is used as the core material 145. Darts (recesses) are formed within a flat sheet to allow the sheet of core material to deform. As the material deforms and approaches the desired shape, the darts close. Typically, a thermal forming process (e.g., 350 degrees Fahrenheit for 3 hours) is used to form the core 145, with other processes also being suitable for use. The cavities of the core 145 adjacent the darts interlock with one another, thereby eliminating the need for foaming core splice adhesive. The core 145 is oriented as described in the ply chart. Specifically, the ribbon direction of the core 145 is arranged such that it is substantially parallel to the X-axis.

Once the first core 145 is positioned adjacent the inner surface of the second ply 85, the first three plies are cured or partially cured. The epoxy within the cloth 50 is self-adhesive, thereby allowing it to bond to itself (i.e., adjacent cloth 50) as well as to the core 145 without the use of a separate adhesive. Generally, the cure is performed using a positive pressure autoclave with a vented vacuum bag at about 35 pounds per square inch. The cure temperature is about 230 degrees Fahrenheit and is maintained for approximately 3 hours.

After the first cure, the filler that makes-up the fourth ply 155 is placed in the core cavities within the densified-core portion 45. Alternatively, the filler 155 can be placed in the cavities prior to the first cure. The filler cures at room temperature and fills the cavities in the densified-core portion 45. The first core 145 is then ground to the desired contour, such as is shown in FIGS. 4 and 9.

The fifth and sixth plies 95, 100 are next installed in the solid flange portion 35 at the orientation listed in Table 1. The seventh and eighth plies 105, 110 are then positioned adjacent an inner surface of the first core 145 and adjacent the inner surface of the sixth ply 100. The seventh and eighth plies 105, 110 each include three sheets 50*a*, 50*b*, 50*c* that are oriented as listed in Table 1 and are arranged similar to the sheets 50*a*, 50*b*, 50*c* that make-up the first and second plies 65, 85 (i.e., three sheets 50*a*, 50*b*, 50*c* defining two seams 75 that are substantially parallel to the X-axis). The second core 150 (ply 9) is then formed and positioned in much the same manner as the first core 145. Specifically, the ribbon direction of the second core 150 is arranged such that it is parallel to the ribbon direction of the first core 145. The assembly is again cured using a similar cure process as was used for the first cure cycle. Again, the arrangement of plies 5–9 is substantially stress neutral to reduce the likelihood of unwanted or unpredictable distortion during the cure cycle.

After the second cure, the filler that makes-up the tenth ply 160 is placed in the core cavities within the densified-core portion 45. Alternatively, the filler is placed in the cavities prior to the second cure. The filler cures at room temperature and fills the cavities in the densified-core portion 45. The second core 150 is then ground to the desired contour, such as is shown in FIGS. 4 and 9.

The eleventh and twelfth plies 120, 125 are next installed in the solid flange portion 35 at the orientation listed in Table 1. The thirteenth and fourteenth plies 130, 135 are then positioned adjacent an inner surface of the second core 150 and adjacent the inner surface of the twelfth ply 125. The thirteenth and fourteenth plies 130, 135 each include three sheets 50*a*, 50*b*, 50*c* that are oriented as listed in Table 1 and are arranged similar to the sheets 50*a*, 50*b*, 50*c* that make up the first and second plies 65, 85 (i.e., three sheets 50*a*, 50*b*, 50*c* defining two seams 75 that are in distinct planes that are substantially parallel to the X-Y plane). Again, the arrangement of plies 10–14 is substantially stress neutral to reduce the likelihood of unwanted or unpredictable distortion during the cure cycle.

Figure 13:
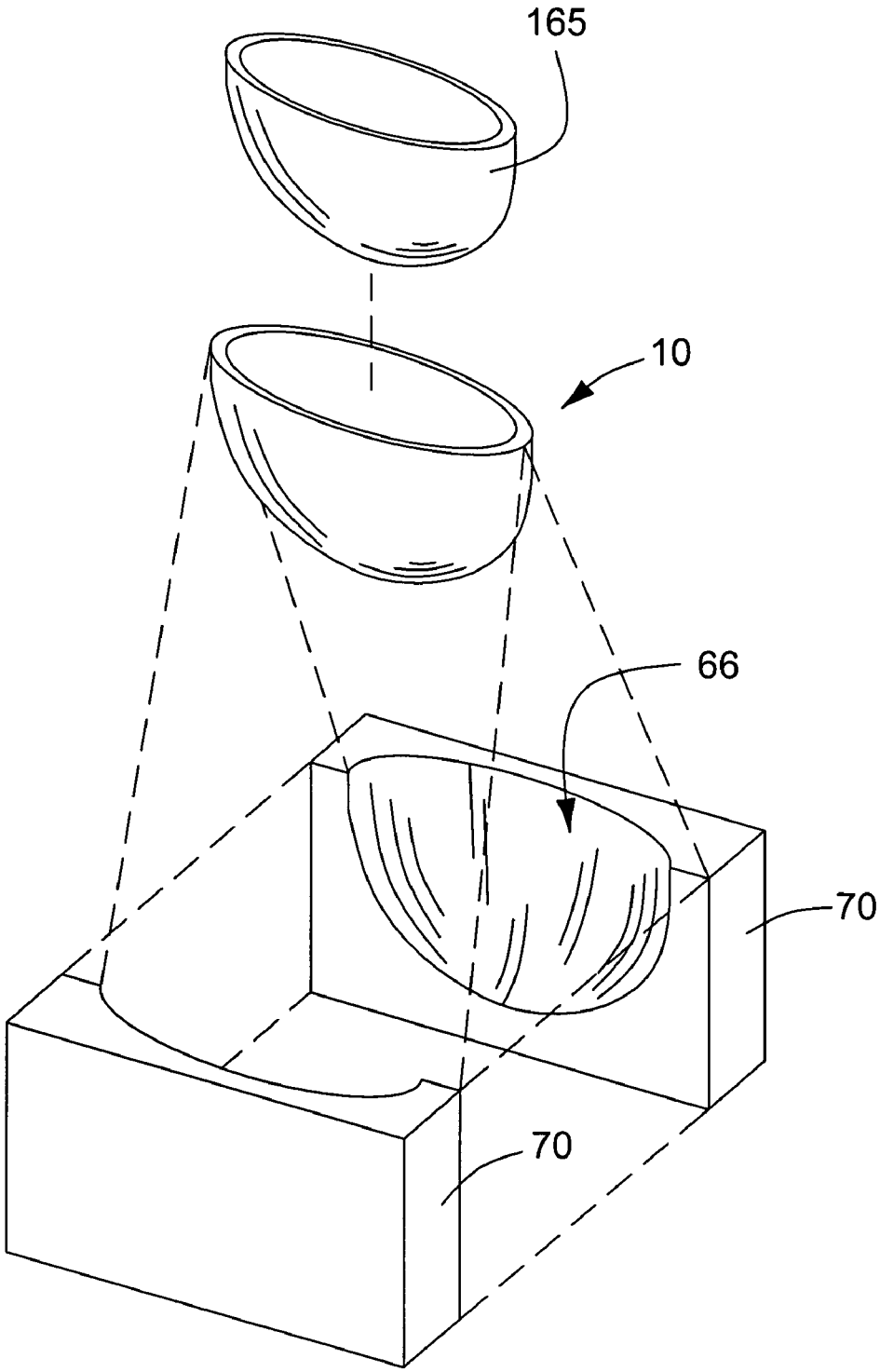
FIG. 13 is an exploded perspective view of a curing system.

With ply fourteen 135 positioned as desired, a flexible caul 165 (shown in FIG. 13) is inserted into the interior of the radome 10. The flexible caul 165 provides a smooth but flexible surface that contacts the inner surface of the radome 10. The assembly is then cured following similar parameters as were described with regard to the first and second cure cycles to complete the radome 10. The use of the caul 165 improves the surface texture of the inner surface such that both the inner surface and the outer surface of the radome 10 are similarly smooth. In an alternative construction, the second cure cycle is omitted such that the radome 10 is manufactured using only the first and third cure cycles.

As illustrated in Table 1, the plies are arranged at various angles relative to the X-axis of the radome 10. The first ply 65 is applied at 45 degrees relative to the X-axis and the second ply 85 is applied at −45 degrees. The fifth ply 95 is applied at 0 degrees, the sixth ply 100 is applied at 90 degrees, the seventh ply 105 is applied at 45 degrees, and the eighth ply 110 is applied at −45 degrees. The eleventh through fourteenth plies 120, 125, 130, 135 are applied in a similar pattern as the fifth through eighth plies 95, 100, 105, 110.

The arrangement of the plies produces a substantially stress neutral structure. As such, the residual stress levels within the structure are low, thereby resulting in fewer problems such as ply separation and distortion. For example, ply 65 and ply 85 are inverted relative to one another in an effort to balance any forces that may be generated during the curing process. One of ordinary skill will realize that other orientations could be used to achieve the desired results. As such, the invention should not be limited to the number or arrangement of plies described herein. In addition, the plies could be applied at different angles and/or the curing cycle could be varied to complete the radome 10. For example, another construction uses fourteen plies as already described but uses only two curing steps; the fourth through fourteenth plies all being cured during the second cure cycle.

Furthermore, many different curing temperatures and times are possible. For example, the construction described herein employs a cure temperature of about 230 degrees Fahrenheit and a dwell time of 3 hours for each cure performed. Other constructions may employ a higher or lower cure temperature and shorter or longer dwell times as may be appropriate for the material selected.

In addition to temperature and time, cure pressure is also an important variable. The present invention employs an autoclave for all cure cycles. The autoclave is pressurized to achieve a pressure of approximately 35 pounds per square inch gauge (psig) on the surface of the radome 10. The pressure pushes the caul 165 against the inner surface to achieve a smooth inner surface. In addition, the high-pressure provides for an increased density part and a significant reduction in the number of voids when compared to a similar component cured in a vacuum.

The thickness of the plies that make up the solid skins 90, 115, 140 and the thickness, or core spacing 170 of the cores 145, 150 affects radar performance. For example, a skin 90, 115, 140 affects radar approximately as a function of the square of the thickness of the skin 90, 115, 140 times its dielectric constant. Therefore, doubling the thickness 175 of a skin 90, 115, 140 will reduce the radar transmissivness through the skin 90, 115, 140 by a factor of four. In addition, the core spacing 170 can affect certain wavelengths of electromagnetic energy differently. As such, the core spacing 170 is tuned to the particular radar being used. For example, certain wavelengths are best transmitted if the core spacing 170 is about 0.125 inches per core 145, 150. To achieve this, a core 145, 150 of 0.135 inches is employed. During the curing process, the core 145, 150 sinks into the adjacent plies. This "cookie cutter" effect results in a spacing between the walls (i.e., a core spacing 170 shown in FIG. 9) on either side of a core 145, 150 that is approximately 0.005 inches (0.010 inches total) less than the actual thickness of the core 145, 150. Thus, a core 145, 150 having a thickness of 0.135 inches will produce a core spacing 170 (i.e., a wall-to-wall measurement) of approximately 0.125 inches. Of course, other core spacing 170 may be desirable in other radar systems. In addition, other wall materials or wall thicknesses 175 may require a different core spacing 170 to achieve the desired results.

The foregoing describes a few variations of the radome. However, as one of ordinary skill in the art will realize, many different variations are possible. For example, more or fewer than fourteen plies could be employed, a single core or more than two cores could be employed, the cores could be eliminated, or each of the skins could be made using a single ply or more than two plies. Other variations, such as the shape of the radome, the spacing of the seams, the quantity of the seams, the curing cycle employed and the quantity of adhesive employed could also be varied if desired. In addition, the thickness of the cloth plies and/or the core plies could also be varied if desired. Thus, it should be clear that many different variations of the radome could be manufactured, in addition to those described herein.

Although the invention has been described in detail with reference to certain preferred embodiments, variations and modifications exist within the scope and spirit of the invention as described and defined in the following claims.

What is claimed is:

1. A radome configured to be used as a cover for a radar antenna, the radome comprising:

a first plurality of plies arranged to define a window portion; and a second plurality of plies arranged to define an attachment portion, wherein a first portion of the first plurality of plies is also included within the second plurality of plies, and a second portion of the first plurality of plies is not included in the second plurality of plies.

2. The radome of claim 1, wherein a first portion of the second plurality of plies is not included in the first plurality of plies.

3. The radome of claim 1, wherein at least one of the second portion of the first plurality of plies is formed from a single substantially continuous sheet of core material.

4. The radome of claim 3, wherein the core material defines a plurality of darts positioned to allow the continuous sheet of material to be formed to the shape of the radome.

5. The radome of claim 3, wherein the continuous sheet of core material includes a nylon fiber material.

6. A radome comprising:

a first plurality of plies arranged to define a window portion; and a second plurality of plies arranged to define an attachment portion, wherein a first portion of the first plurality of plies is also included within the second plurality of plies, and a second portion of the first plurality of plies is not included in the second plurality of plies, wherein at least one of the plies of the first portion of the first plurality of plies includes a first sheet having a first edge and a second sheet having a second edge, the first edge and the second edge abutting one another to define a first seam.

7. The radome of claim 6, wherein the first sheet and the second sheet include adhesive impregnated cloth.

8. The radome of claim 7, wherein each of the first sheet and the second sheet is capable of holding a maximum quantity of adhesive, and wherein the first sheet and the second sheet include between about 30 percent to 80 percent of the maximum quantity.

9. The radome of claim 8, wherein the first sheet and the second sheet include about 55 percent of the maximum quantity.

10. The radome of claim 6, wherein the at least one ply includes a third sheet having a third edge and the second sheet defines a fourth edge positioned to abut the third edge and define a second seam.

11. The radome of claim 10, wherein the first seam is disposed substantially within a first plane and the second seam is disposed substantially within a second plane that is substantially parallel to the first plane and spaced a non-zero distance from the first plane.

12. The radome of claim 10, wherein at least one of the first seam and the second seam includes a butt joint.

13. The radome of claim 12, wherein the window portion defines a substantially ellipsoid shape having a long axis, and wherein the first and second seams are substantially parallel to the long axis.

14. A radome configured to cover a radar antenna, the radome comprising:

an outer skin defining a first interior space having a first contour, and defining an exterior surface of a window portion and of an attachment portion;

a first core portion formed to substantially corresponding to the first contour and disposed within the first interior space adjacent the outer skin, the first core portion defining a second interior space;

a middle skin disposed at least partially within the second interior space adjacent the first core and defining a third interior space having a second contour, the middle skin extending into the window portion and the attachment portion;

a second core portion formed to substantially correspond to the second contour and disposed within the third interior space adjacent the middle skin, the second core portion defining a fourth interior space; and an inner skin disposed at least partially within the fourth interior space adjacent the second core, the inner skin extending into the window portion and the attachment portion and defining an interior surface of the window portion and the attachment portion, wherein at least one of the first core portion and the second core portion does not extend into the attachment portion.

15. The radome of claim 14, wherein the outer skin, the middle skin, and the inner skin cooperate to at least partially define the attachment portion.

16. The radome of claim 14, wherein both the first core portion and the second core portion do not extend into the attachment portion.

17. A radome configured to cover a radar antenna, the radome comprising:

an outer skin defining a first interior space having a first contour, and defining an exterior surface of a window portion and of an attachment portion;

a first core portion formed to substantially corresponding to the first contour and disposed within the first interior space adjacent the outer skin, the first core portion defining a second interior space;

a middle skin disposed at least partially within the second interior space adjacent the first core and defining a third interior space having a second contour, the middle skin extending into the window portion and the attachment portion;

a second core portion formed to substantially correspond to the second contour and disposed within the third interior space adjacent the middle skin, the second core portion defining a fourth interior space; and an inner skin disposed at least partially within the fourth interior space adjacent the second core, the inner skin extending into the window portion and the attachment portion and defining an interior surface of the window portion and the attachment portion, wherein each of the outer skin, the middle skin, and the inner skin includes a first ply and a second ply.

18. The radome of claim 17, wherein at least some of the plies include a polyethylene fiber cloth impregnated with adhesive.

19. The radome of claim 18, wherein the plies that include adhesive are capable of holding a maximum quantity of adhesive, and wherein the first sheet and the second sheet include about 30 percent to about 80 percent of the maximum quantity.

20. The radome of claim 17, wherein each first ply and second ply is oriented to produce a substantially stress neutral outer skin, middle skin, and inner skin.

21. The radome of claim 17, wherein each first ply and second ply includes a first sheet and a second sheet abutting the first sheet to define a seam.

22. The radome of claim 21, wherein each of the seams is substantially disposed within one of a plurality of planes, and wherein each plane is substantially parallel to each of the remaining planes and is spaced a non-zero distance from each of the remaining planes.

* * * * *